US007383817B2

(12) United States Patent
Horiuchi et al.

(10) Patent No.: US 7,383,817 B2
(45) Date of Patent: Jun. 10, 2008

(54) INJECTOR

(75) Inventors: Yasuhiro Horiuchi, Toyota (JP); Yutaka Miyamoto, Takahama (JP)

(73) Assignees: Denso Corporation (JP); Nippon Soken, Inc. (JP)

( * ) Notice: Subject to any disclaimer, the term of this patent is extended or adjusted under 35 U.S.C. 154(b) by 0 days.

(21) Appl. No.: 11/713,015

(22) Filed: Mar. 2, 2007

(65) Prior Publication Data

US 2007/0215714 A1 Sep. 20, 2007

(30) Foreign Application Priority Data

Mar. 16, 2006 (JP) ..... 2006-073196

(51) Int. Cl.
*F02M 57/02* (2006.01)
*F02M 57/00* (2006.01)

(52) U.S. Cl. ..... 123/446; 123/456

(58) Field of Classification Search ..... 123/446, 123/447, 467, 456, 459; 239/88–92, 533.2
See application file for complete search history.

(56) References Cited

U.S. PATENT DOCUMENTS 5,713,520 A 2/1998 Glassey et al.
5,950,601 A 9/1999 Nemoto et al.
6,427,664 B1 8/2002 Boecking
2002/0084348 A1 7/2002 Boecking
2005/0035212 A1 2/2005 Eisenmenger et al.
2006/0186221 A1* 8/2006 Heinz et al. ..... 239/88
2006/0208107 A1* 9/2006 Heinz ..... 239/533.2
2006/0283983 A1* 12/2006 Boecking ..... 239/533.2

FOREIGN PATENT DOCUMENTS

JP 2003-106235 4/2003

OTHER PUBLICATIONS

German Examination Report dated Oct. 18, 2007 in German Application No. 10 2007 000 150.0-13 with English translation.

* cited by examiner

*Primary Examiner*—Mahmoud Gimie
(74) *Attorney, Agent, or Firm*—Nixon & Vanderhye PC

(57) ABSTRACT

An injector includes a boosting mechanism and a nozzle. The boosting mechanism boosts fuel, and the nozzle injects and supplies the fuel boosted by the boosting mechanism. The boosting mechanism includes a tubular piston and a column piston. The tubular piston has a bore, which extends through the tubular piston in a direction of a longitudinal axis of the tubular piston. The column piston is loosely received by the tubular piston and has an end portion, which projects from the tubular piston, and which is engaged with the tubular piston. The tubular piston is slidably received by a first cylinder. The end portion of the column piston is slidably received by a second cylinder, which is provided generally coaxially to the first cylinder, and which has a diameter different from that of the first cylinder.

4 Claims, 2 Drawing Sheets

INJECTOR

CROSS REFERENCE TO RELATED APPLICATION

This application is based on and incorporates herein by reference Japanese Patent Application No. 2006-73196 filed on Mar. 16, 2006.

BACKGROUND OF THE INVENTION

1. Field of the Invention

The present invention relates to an injector that injects and supplies fuel to an engine.

2. Description of Related Art

Conventionally, an injector is mounted on a direct injection engine (e.g., a diesel engine), which receives fuel from a fuel supply source (e.g., common rail) for directly injecting and supplying the fuel into a cylinder of an engine.

Recently, in order to improve an efficiency of combustion by further atomizing fuel spay of the fuel injected through the injector, injection pressure of the fuel by the injector has been increased. And, there has been a study for even aggressively increasing the pressure by providing a boosting mechanism (intensifier mechanism) to the injector, not only by increasing supply pressure of the fuel in a fuel supply source.

For example, the boosting mechanism includes a boosting piston (intensifier piston), which integrally includes a large-diameter piston member and a small-diameter piston member. Here, the large-diameter piston member is slidably received in a large-diameter cylinder, and the small-diameter piston member is slidably received in a small-diameter cylinder. Also, the boosting mechanism blocks the large-diameter cylinder by the large-diameter piston member to form (define) a boosting chamber, which the fuel as a boosting medium flows into and out of. Also, the boosting mechanism blocks the small-diameter cylinder by the small-diameter piston member to form (define) a boosted chamber, which fuel to be boosted flows into and out of.

Then, the boosting mechanism boosts the fuel (increases the pressure of the fuel) in the boosted chamber in accordance with an area ratio between an end face (boosting surface) of the large-diameter piston member and an end face (boosted surface) of the small-diameter piston member. Here, the end face (boosting surface) is exposed to the boosting chamber and applies pressure to the fuel in the boosting chamber, and the end face (boosted surface) is exposed to the boosted chamber and applies pressure to the fuel in the boosted chamber (see, for example, JP-A-2003-106235).

By the way, in order to retain oil tightness in the boosting mechanism, a clearance (large-diameter side slide clearance) and a clearance (small-diameter side slide clearance) both need to be set small to be, for example, 1~5 m. Here, the clearance (large-diameter side slide clearance) is a clearance between the inner peripheral surface of the large-diameter cylinder and the outer peripheral surface of the large-diameter piston member, and the clearance (small-diameter side slide clearance) is a clearance between the inner peripheral surface of the small-diameter cylinder and the outer peripheral surface of the small-diameter piston member.

However, when the boosting piston is formed in a condition, where the large-diameter piston member and the small-diameter piston member are integrally formed with each other and are generally coaxially to each other, an erroneous measurement of an axial center position of the large-diameter piston member against that of the small-diameter piston member needs to be set smaller than a total measurement of the large-diameter and small-diameter side slide clearances in order to retain appropriate slidability. Then, it is very difficult to machine the boosting piston with a high degree of accuracy in the coaxiality between the large-diameter piston member and the small-diameter piston member under a condition where the large-diameter and small-diameter side slide clearances are set smaller as above.

Further, when the injector is assembled and fixed to the engine, the injector is applied with a very large fixing force. Therefore, because of the fixing force, the error may be generated in the axial center positions between the large-diameter piston member and the small-diameter piston member. Then, in the boosting piston, where the large-diameter and small-diameter side slide clearances are set small and also the coaxiality is formed highly accurately, slide deficiency of the large-diameter and small-diameter piston members may occur with a very high probability due to the above error of the axial center positions.

Thus, according to the conventional boosting mechanism, in order to retain the oil tightness in the boosting mechanism, the large-diameter and small-diameter side slide clearances need to be set small. But on the other side, the slide deficiency of the large-diameter and small-diameter piston members may occur with the very high probability due to the fact that the large-diameter and small-diameter side slide clearances are set small. Therefore, the injector having the conventional boosting mechanism has difficulty in retaining both the oil tightness and the slidability.

SUMMARY OF THE INVENTION

The present invention is made in view of the above disadvantages. Thus, it is an objective of the present invention to address at least one of the above disadvantages.

To achieve the objective of the present invention, there is provided an injector, which includes a boosting mechanism and a nozzle. The boosting mechanism boosts fuel, and the nozzle injects and supplies the fuel boosted by the boosting mechanism. Here, the boosting mechanism includes a tubular piston and a column piston. The tubular piston has a bore, which extends through the tubular piston in a direction of a longitudinal axis of the tubular piston, and the column piston is loosely received by the tubular piston, and has an end portion, which projects from the tubular piston, and which is engaged with the tubular piston. The tubular piston is slidably received by a first cylinder. The end portion of the column piston is slidably received by a second cylinder, which is provided generally coaxially to the first cylinder, and which has a diameter different from that of the first cylinder.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF PREFERRED EMBODIMENTS

Figure 1:
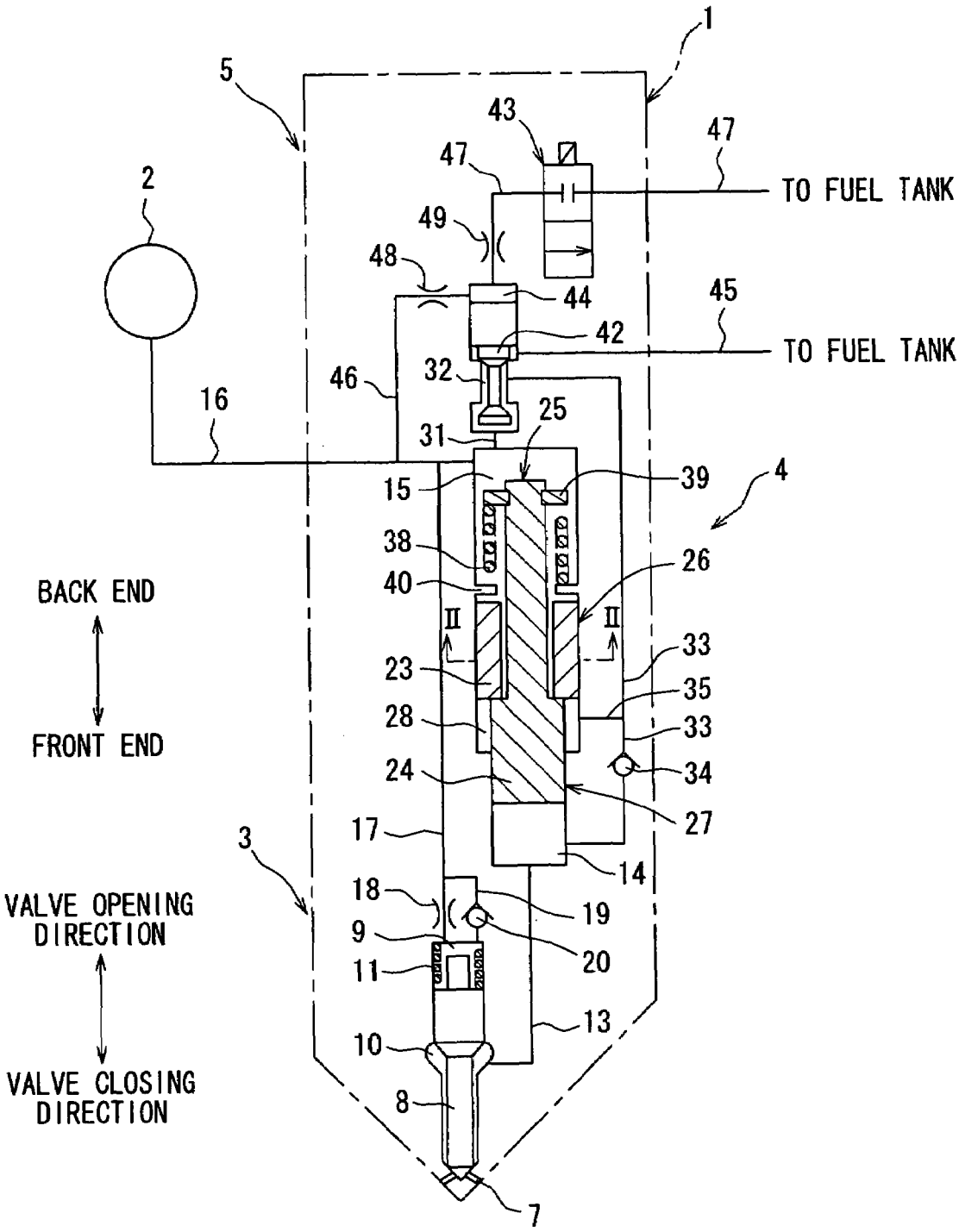
FIG. 1 is an explanation view showing a structure of an injector according to an embodiment of the present invention.

A structure of an injector 1 of the preferred embodiment of the present embodiment will be described with reference to FIG. 1. A common rail fuel injection system_for injecting and supplying fuel into an engine (not shown) includes, for example, the injector 1, a fuel supply pump (not shown) for increasing pressure of the fuel, and a common rail 2 for accumulating the fuel highly pressurized by a fuel supply pump under a high-pressure state. And, the injector 1 is mounted on the engine to injects the fuel into a cylinder of the engine.

The injector 1 includes, for example, a nozzle 3 for injecting the fuel, a boosting mechanism 4 for boosting (intensifying) the fuel (i.e., for increasing pressure of the fuel) to supply to the nozzle 3, and a control valve 5 for operating the nozzle 3 and the boosting mechanism 4.

The nozzle 3 includes a needle 8 for opening and closing injection holes 7. Also, the nozzle 3 forms (defines) a back pressure chamber 9 and a nozzle chamber 10. Here, the fuel, which applies pressure to a needle 8 in a valve closing direction for closing the injection holes 7, flows into the back pressure chamber 9, and the fuel, which applies pressure in a valve opening direction for opening the injection holes 7, flows into the nozzle chamber 10. Also, the nozzle 3 receives a restoring spring 11 in the back pressure chamber 9 for spring biasing the needle 8 in the valve closing direction. That is, the needle 8 is biased in the valve closing direction by the pressure in the back pressure chamber 9 and by the restoring spring 11, and also is biased in the valve opening direction by the pressure in the nozzle chamber 10.

Here, the nozzle chamber 10 communicates with a boosted chamber 14, which will be described later, through a fuel passage 13. The boosted chamber 14 is a fuel chamber, in which the fuel is boosted (i.e., the pressure of the fuel is intensified) by the boosting mechanism 4. Also, the back pressure chamber 9 communicates with the common rail 2 through a boosting chamber 15, which will be described later, and through a fuel passage 17. Here, the fuel passage 17 branches from a fuel passage 16 that communicates with the common rail 2. Also, the fuel passage 17 includes a throttle 18 for regulating a fuel flow (inflow and outflow) of the back pressure chamber 9.

Further, a fuel passage 19, which bypasses the throttle 18 to connect with the back pressure chamber 9, branches from the fuel passage 17. Then, the fuel passage 19 is provided with a check valve 20, which limits the fuel from flowing out of the back pressure chamber 9, and which permits the fuel to flow into the back pressure chamber 9 through the fuel passage 19.

Because of the above structure, in the nozzle 3, when the boosted fuel, which is boosted by the boosting mechanism 4, flows into the nozzle chamber 10 through the fuel passage 13, the needle 8 is lifted to open the injection holes 7, and therefore, the fuel in the nozzle chamber 10 is injected. Also, at the same time, the fuel flows out of the back pressure chamber 9 through the fuel passage 17. In contrast, when the boosting mechanism 4 stops boosting the fuel (i.e., stops intensifying the pressure of the fuel), the needle 8 descends (i.e., displaces in the valve closing direction) to close the injection holes 7, and the fuel injection is stopped. Also, at the same time, the check valve 20 is opened, so that the fuel flows into the back pressure chamber 9 through the fuel passages 17, 19.

The boosting mechanism 4 includes a tubular piston 23 and a column piston 25. Here, the tubular piston 23 has a bore that extends through the tubular piston 23 in a longitudinal direction, and the column piston 25 is loosely received by the tubular piston 23. The column piston 25 has an end portion 24, which projects from the tubular piston 23 in a front end direction, and which is engaged with an end portion of the tubular piston 23.

Then, the tubular piston 23 is slidably received by a first cylinder 26 (large-diameter cylinder) and the end portion 24 of the column piston 25 is slidably received by a second cylinder 27 (small-diameter cylinder), which is formed to be coaxial to the first cylinder 26 and to have a diameter smaller than that of the first cylinder 26. That is, the end portion 24 has a diameter larger than an inner diameter of the tubular piston 23, and smaller than an outer diameter of the tubular piston 23.

Here, each of a first clearance (large-diameter side slide clearance) and a second clearance (small-diameter side slide clearance) is designed to be 2 μm in order to retain oil tightness. Here, the first clearance (large-diameter side slide clearance) is a clearance between an inner peripheral surface of the first cylinder 26 and an outer peripheral surface of the tubular piston 23, and the second clearance (small-diameter side slide clearance) is a clearance between an inner peripheral surface of the second cylinder 27 and an outer peripheral surface of the end portion 24.

Figure 2:
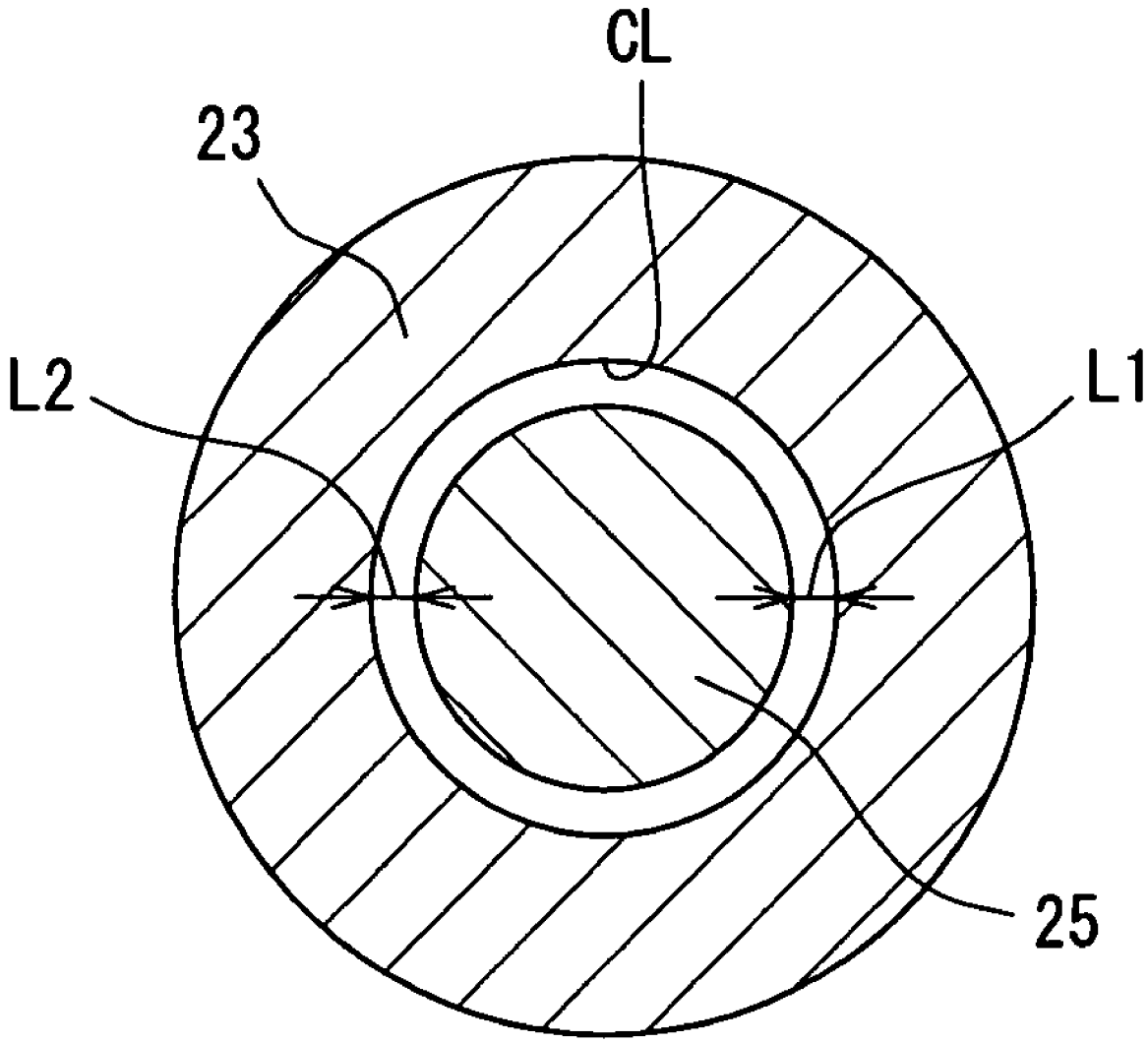
FIG. 2 is a schematic view of a tubular piston and a column piston of a boosting mechanism taken along line II-II in FIG. 1.

Also, the column piston 25 is loosely received by the tubular piston 23 to form an annular loosely receiving clearance CL. Here, the annular loosely receiving clearance CL is defined such that a total clearance of the annular loosely receiving clearance CL in a direction approximately transverse to the longitudinal axis (an axial center) of the tubular piston 23 is at least 20 μm. Specifically, the annular loosely receiving clearance CL has dimensions of a first radial clearance length L1 and a second radial clearance length L2 (see FIG. 2), and the second radial clearance length L2 corresponds to one part of the annular loosely receiving clearance CL opposite from another part corresponding to the first radial clearance length L1 relative to a longitudinal axial center of the tubular piston 23. Here, the annular loosely receiving clearance CL is defined such that a total of the first radial clearance length L1 and the second radial clearance length L2 is at least 20 μm. In the present embodiment, the annular loosely receiving clearance CL is defined such that the total of the first radial clearance length L1 and the second radial clearance length L2 is 100 μm.

Also, the boosting mechanism 4 forms (includes) the boosting chamber 15, the boosted chamber 14, and a boosting control chamber 28. Here the fuel acting as a boosting medium flows into and out of the boosting chamber 15, and the fuel is boosted in the boosted chamber 14. Also, the fuel, which applies the pressure to the fuel in the direction for reducing the pressure in the boosted chamber 14, flows into and out of the boosting control chamber 28.

The boosting chamber 15 is defined by that the outer peripheral surface of the tubular piston 23 slides with the inner peripheral surface of the first cylinder 26 and the end portion 24 is engaged with the end portion of the tubular piston 23. Then, the boosting chamber 15 communicates with the common rail 2 through the fuel passage 16 to receives the fuel, which is accumulated in the common rail 2, as the boosting medium. Also, the boosting chamber 15 communicates with a control valve chamber 32, which will be described later, through a fuel passage 31.

The boosted chamber 14 is defined by that the end portion 24 blocks the second cylinder 27 from a back end side. Then, the boosted chamber 14 communicates with the control valve chamber 32 through a fuel passage 33 to receive the fuel from the common rail 2 through the fuel passage 16, boosting chamber 15, the fuel passage 31, the control valve chamber 32, and the fuel passage 33. Here, the fuel passage 33 is provided with a check valve 34 that limits the boosted fuel, which is boosted in the boosted chamber 14, from flowing toward the control valve chamber 32.

The boosting control chamber 28 is defined by that the outer peripheral surface of the tubular piston 23 slides with the inner peripheral surface of the first cylinder 26, by that the end portion 24 is engaged with the end portion of the tubular piston 23, and by that the end portion 24 blocks the second cylinder 27 from the back end side.

Then, the boosting control chamber 28 is connected with a fuel passage 35, which branches from the fuel passage 33, and is connected with the control valve chamber 32 through the fuel passages 33, 35. Then, the fuel flows between the boosting control chamber 28 and the control valve chamber 32 through the fuel passages 33, 35. Here, switching of a flow direction of the fuel in the fuel passages 33, 35 is operated by the control valve 5.

By the above structure, in the boosting mechanism 4, when the fuel flows out of the boosting control chamber 28 through the fuel passages 33, 35, the pressure in the boosting control chamber 28 decreases. Simultaneously, the tubular and column pistons 23, 25 displace in the front end direction, and therefore the fuel flows into the boosting chamber 15 from the common rail 2 through the fuel passage 16, and the fuel in the boosted chamber 14 is boosted to be supplied to the nozzle chamber 10.

When the flow direction of the fuel in the fuel passages 33, 35 is switched eventually, the fuel flows into the boosting control chamber 28 through the fuel passage 16, the boosting chamber 15, the fuel passage 31, the control valve chamber 32, and the fuel passages 33, 35. Due to this, the tubular and column pistons 23, 25 displace in the back end direction as shown in FIG. 1, so that the fuel boosting is stopped and the check valve 34 is opened. Thus, the fuel flows from the common rail 2 also into the boosted chamber 14 through the similar passages as above.

Also, the boosting mechanism 4 includes a restoring spring 38, which biases the column piston 25 in a direction (i.e., the back end direction) for reducing the pressure of the fuel in the boosted chamber 14. The restoring spring 38 is provided between an E-shaped ring 39, which is mounted to the back end of the column piston 25, and a spring seat 40, which is provided to radially inwardly project in the first cylinder 26.

Then, the restoring spring 38 together with the pressure in the boosted chamber 14 biases the column piston 25 in the back end direction (the direction for reducing the pressure in the boosted chamber 14) and that the pressure in the boosting chamber 15 biases the tubular piston 23 in the front end direction, so that the end portion 24 is strongly engaged with the end portion of the tubular piston 23. Due to this, the oil tightness at the engaging portion between the tubular piston 23 and the column piston 25 can be effectively retained.

Here, because the pressure in the boosting control chamber 28 biases the tubular piston 23 in the back end direction, the pressure applies in a direction for weakening the engagement between the tubular piston 23 and the column piston 25. When the fuel is boosted by the boosting mechanism 4, the pressure in the boosting control chamber 28, which applies in the direction for weakening the engagement between the tubular piston 23 and the column piston 25, decreases, and therefore, the pressure in the boosted chamber 14, which applies in a direction for enhancing the engagement between the tubular piston 23 and the column piston 25, increases.

Thus, when the boosting mechanism 4 boosts the fuel, the engagement between the tubular piston 23 and the column piston 25 is further enhanced (made stronger), and therefore, the oil tightness at the engaging portion between the tubular piston 23 and the column piston 25 is enhanced.

The control valve 5 includes a valve body 42, which switches the flow direction of the fuel in the fuel passages 33, 35, and a solenoid valve 43, which drives the valve body 42. Here, the solenoid valve 43 has a known structure, which opens a valve when energized.

The valve body 42 is slidably received by a predetermined fuel chamber to form (define) the control valve chamber 32 and a control chamber 44. The control valve chamber 32 loosely receives a valve portion of the valve body 42, and is connected with three passages (i.e., the fuel passages 31, 33 and a fuel passage 45 that communicates with a fuel tank). Also, the control chamber 44 is blocked by a piston portion of the valve body 42 from the front end side, and communicates with a fuel passage 46, which branches from the fuel passage 16, and with the fuel tank. Further, the control chamber 44 also communicates with a fuel passage 47, which is opened and closed by the solenoid valve 43. Here, the fuel passages 46, 47 are provided with throttles 48, 49, respectively, for regulating the flow of the fuel in each passage.

Due to the above, when the solenoid valve 43 is opened and the fuel flows from the control chamber 44 into the fuel tank through the fuel passage 47, the pressure in the control chamber 44 decreases. Therefore, valve body 42 displaces in the back end direction. Due to this, the fuel passage 31 is disconnected from the fuel passage 33, and at the same time the fuel passage 33 gets communication with the fuel passage 45.

Therefore, through the fuel passages 33, 35, the control valve chamber 32, and the fuel passage 45, the fuel flows from the boosting control chamber 28 into the fuel tank, so that the pressure in the boosting control chamber 28 decreases. As a result, the boosting mechanism 4 boosts the fuel, so that the boosted fuel is supplied from the boosted chamber 14 into the nozzle chamber 10.

Also, when the solenoid valve 43 is closed so that the fuel does not flow through the control chamber 44 via the fuel passage 47, the fuel flows from the common rail 2 into the control chamber 44 through the fuel passages 16, 46. Therefore, the pressure in the control chamber 44 increases so that the valve body 42 displaces in the front end direction. Due to this, the fuel passage 33 is disconnected from the fuel passage 45, and at the same time the fuel passage 31 gets communication with the fuel passage 33.

Due to this, through the fuel passage 16, the boosting chamber 15, the fuel passage 31, the control valve chamber 32, and the fuel passages 33, 35, the fuel flows from the common rail 2 into the boosting control chamber 28, and further, the check valve 34 is opened so that the fuel flows also into the boosted chamber 14. As a result, the pressure in the boosting control chamber 28 increases and the boosting mechanism 4 stops boosting the fuel. Thus, the fuel supply from the boosted chamber 14 to the nozzle chamber 10 is stopped.

Advantages of the present embodiment will be described. According to the injector 1 of the present embodiment, the boosting mechanism 4 includes the tubular piston 23 and the column piston 25. Here, the tubular piston 23 has the bore that extends in the longitudinal direction, and the column piston 25 is loosely received by the tubular piston 23 and has the end portion 24, which projects from the tubular piston 23 in the front end direction and which is engaged with the tubular piston 23. Then, the tubular piston 23 is slidably received by the first cylinder 26, and the end portion 24 of the column piston 25 is slidably received by the second cylinder 27, which is formed to be coaxial to the first cylinder 26 and to have the diameter smaller than the first cylinder 26.

Due to this, the tubular piston 23 and the column piston 25 are engaged with each other, and displace together with each other (i.e., the tubular piston 23 and the column piston 25 are not integrally formed with each other). Therefore, even when each of the large-diameter and small-diameter side slide clearances is designed to be as small as 2 μm in order to retain the oil tightness, restriction, which is applied to one of the tubular piston 23 and the column piston 25 by the other, is small when the pistons 23, 25 move. As a result, the moving direction of the tubular piston 23 is made more independent of the moving direction of the column piston 25, so that slide deficiency of the tubular piston 23 and the end portion 24 of the column piston 25 (e.g., the slide deficiency of the pistons 23, 25 in the corresponding cylinders) is limited from occurring.

As above, in the boosting mechanism 4 of the injector 1, both the oil tightness and the slidability can be retained.

Also, the boosting mechanism 4 includes the restoring spring 38, which biases the column piston 25 in the back end direction.

Due to this, the engagement between the tubular piston 23 and the column piston 25 is enhanced so that the oil tightness is effectively enhanced at the engaging portion between the tubular piston 23 and the column piston 25.

Also, according to the injector 1 of the present embodiment, the column piston 25 is loosely received by the tubular piston 23 to form the annular loosely receiving clearance CL. Then, the annular loosely receiving clearance CL is defined such that the total clearance of the annular loosely receiving clearance CL in the direction approximately transverse to the axial center of the tubular piston 23 is at least 20 μm.

Due to this, in the boosting mechanism 4, where each of the large-diameter and small-diameter side slide clearances is designed to be as small as 2 μm, an error amount of axial center positions of the tubular piston 23 and the column piston 25 (e.g., an error amount of the axial center positions of the tubular piston 23 and the end portion of the column piston 25) can be reliably compensated. Here, the error amount may be caused by the fixing force applied to the injector 1. Therefore, the slidability of the tubular piston 23 and the end portion 24 can be reliably retained.

Modification will be described. In the boosting mechanism 4 of the present embodiment, the end portion 24, which has the diameter smaller than the outer diameter of the tubular piston 23, projects from the tubular piston 23 in the front end direction to be engaged with the end portion of the tubular piston 23. However, a back end portion of the column piston 25 may have a diameter larger than the outer diameter of the tubular piston 23, and this back end portion may projects from the tubular piston 23 in the back end direction to be engaged with a back end of the tubular piston 23. In this modified case, the similar advantages similar to the present embodiment can be obtained.

Additional advantages and modifications will readily occur to those skilled in the art. The invention in its broader terms is therefore not limited to the specific details, representative apparatus, and illustrative examples shown and described.

What is claimed is:

1. An injector comprising:

a boosting mechanism that boosts fuel; and a nozzle that injects and supplies the fuel boosted by the boosting mechanism, wherein:

the boosting mechanism includes:

a tubular piston that has a bore, which extends through the tubular piston in a direction of a longitudinal axis of the tubular piston; and a column piston having a first portion that is loosely received by the tubular piston to define a clearance and having a second portion, which projects from the tubular piston, and which engages with the tubular piston, the first portion having a diameter smaller than a diameter of the second portion;

the tubular piston is slidably received by a first cylinder; and the second portion of the column piston is slidably received by a second cylinder, which is provided generally coaxially to the first cylinder, and which has a diameter different from that of the first cylinder, the second cylinder and an end portion of the second portion opposite the tubular piston defining a boosted chamber.

2. The injector according to claim 1, wherein:

the boosting mechanism includes:

a boosting chamber that is defined by the first cylinder, wherein the first cylinder has a diameter larger than the second cylinder, and the fuel, which acts as a boosting medium, flows into and out of the boosting chamber; and a biasing device that biases one of the tubular piston and the column piston in a direction for reducing pressure of the fuel in the boosted chamber, wherein the one of the tubular piston and the column piston is slidably received by the second cylinder.

3. The injector according to claim 1, wherein:

clearance is an annular loosely receiving clearance; and the annular loosely receiving clearance is defined such that a total clearance of the annular loosely receiving clearance in a direction approximately transverse to the longitudinal axis of the tubular piston is at least 20 μm.

4. The injector according to claim 1, wherein the second portion of the column piston engages a longitudinal end of said tubular piston.

* * * * *